United States Patent [19]

Tipton et al.

[11] 3,940,459

[45] Feb. 24, 1976

[54] MEANS AND METHOD FOR SECURING A METERING ROD LIFTER CAM ON A THROTTLE SHAFT OF A CARBURETOR

[75] Inventors: Larry J. Tipton, Florissant; Donald A. Rebmann, Fenton; Donald A. Reise, St. Ann, all of Mo.

[73] Assignee: ACF Industries, Incorporated, New York, N.Y.

[22] Filed: Nov. 4, 1974

[21] Appl. No.: 520,282

[52] U.S. Cl. ..... 261/23 A; 261/51; 403/355

[51] Int. Cl.[2] ..... F02M 11/02

[58] Field of Search ..... 261/23 A, 51; 403/355

[56] References Cited

UNITED STATES PATENTS

| | | | |
|---|---|---|---|
| 214,954 | 4/1879 | Ribon | 403/355 |
| 1,100,504 | 6/1914 | Taft | 403/355 |
| 2,659,062 | 11/1953 | Tibbetts | 403/355 |
| 2,689,116 | 9/1954 | Richardson | 261/51 |
| 2,703,229 | 3/1955 | Henning | 261/23 A |
| 3,070,390 | 12/1962 | Schroter et al. | 403/355 |
| 3,269,377 | 8/1966 | Fleming | 261/51 |
| 3,279,767 | 10/1966 | Stoltman | 261/23 A |
| 3,628,773 | 12/1971 | Kehoe et al. | 261/23 A |
| 3,695,589 | 10/1972 | Lamore | 261/50 A |

*Primary Examiner*—Tim R. Miles

[57] ABSTRACT

A multi-barrel carburetor for an internal combustion engine has a primary throttle shaft and a metering rod lifter cam thereon. The metering rod lifter cam is generally C-shaped and has an inwardly projecting tongue which fits within a tapered groove in the throttle shaft for securing the cam thereon. The C-shaped cam is first inserted over a flat on the shaft and the groove in the shaft is aligned axially with the tongue of the cam. Then the shaft is slipped axially while the cam is held in position thereby to engage the tongue with the groove for securing the cam onto the throttle shaft.

7 Claims, 5 Drawing Figures

MEANS AND METHOD FOR SECURING A METERING ROD LIFTER CAM ON A THROTTLE SHAFT OF A CARBURETOR

BACKGROUND OF THE INVENTION

Heretofore, metering rod lifter cams for internal combustion engine carburetors have been provided on a primary throttle shaft to raise a push rod and associated metering rods for increasing the flow of fuel upon opening of the throttle valve. It has been common to secure the cam onto the throttle shaft with a threaded connection which necessitates a screw tapping operation and the alignment of the cam with the threaded opening on the throttle shaft in order to position accurately the cam. In the event the threaded opening on the throttle shaft or the opening on the cam receiving the screw is not positioned accurately this could affect operation of the cam and provide a variable in flow test uniformity between carburetors. The cam normally has been formed heretofore as a relatively thin metal stamping which is difficult for maintaining uniformity and is subject to undue wear in certain instances.

DESCRIPTION OF THE PRESENT INVENTION

An internal combustion engine carburetor having a body structure with a pair of spaced parallel mixture conduits has a throttle shaft extending through the mixture conduits and across the space formed between the mixture condutis. The present invention is particularly adaptable for use with four-barrel carburetor systems in which primary and secondary throttles are manually controlled in a sequential manner. Secondary mixture conduits for the secondary throttle are normally of a larger diameter than the primary mixture conduits and thus, a space is formed between the primary mixture conduits as the primary and secondary mixture conduits are usually transversely aligned.

The metering rod lifter cam of the present invention is mounted on the main throttle shaft in the space between the primary mixture conduits and is easily positioned and secured to the throttle shaft in a minimum of time without the use of any screws or separate securing elements. The cam is formed of oil impregnated sintered iron and is of a relatively large thickness, such as one-fourth inch, to provide a relatively large contact or bearing area with the cam follower thereby to minimize any wear of the cam. The cam is C-shaped having an inwardly projecting tongue or extension fitting within a slot extending axially of the throttle shaft, and the slot communicates with a cutaway portion of the shaft adjacent an end of the slot.

In assembly of the cam onto the shaft, the shaft is first positioned within openings formed in the carburetor body and the cutaway portion of the shaft is initially positioned in the space formed between the main mixture conduits. While the cutaway portion is exposed, the C-shaped cam is slipped over the cutaway portion and the tongue on the cam is axially aligned with the slot on the throttle shaft by manual rotation or twisting of the throttle shaft. After alignment the throttle shaft is moved axially to position the tongue within the slot and then throttle valves are secured ot the throttle shaft. After the throttle valves have been secured to the shaft, the shaft is fixed longitudinally and the cam is thereby held in position with the tongue of the cam engaging the slot in the shaft.

The invention for purposes of illustration and description is shown in the accompanying drawings, forming a part of this specification, wherein.

Figure 1:
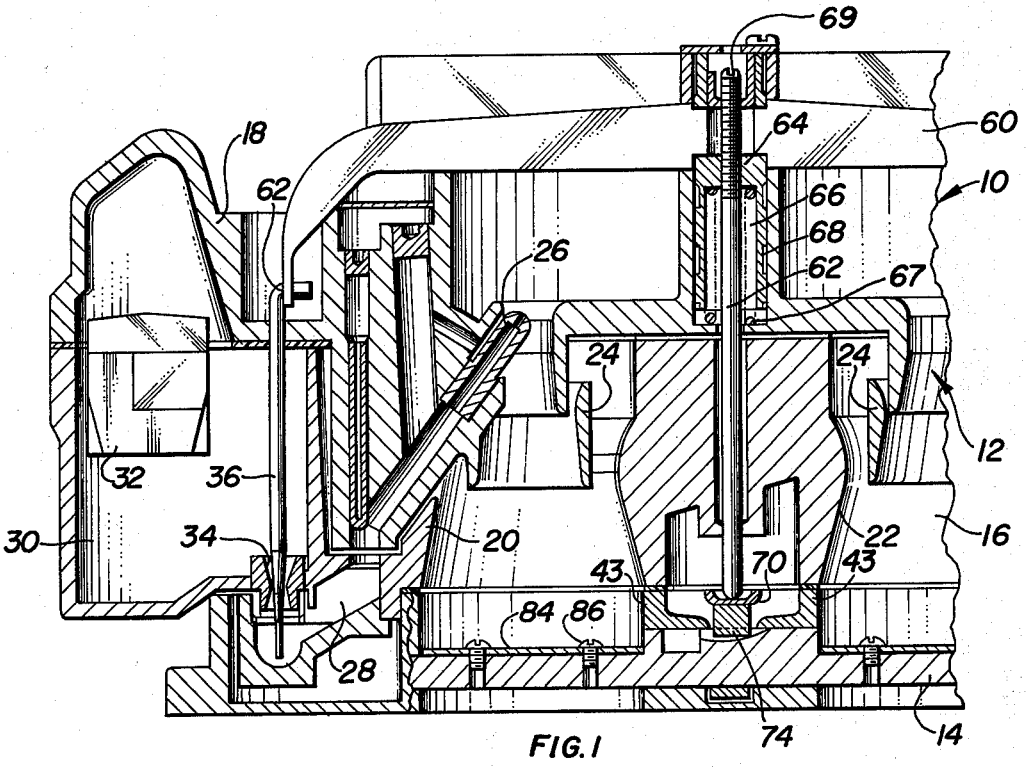
FIG. 1 is a longitudinal section taken through the two primary mixture conduits of a two-stage four-barrel carburetor constructed in accordance with the present invention.
Figure 4:
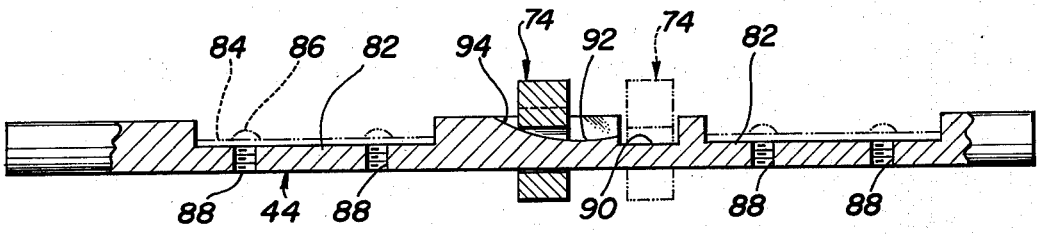
FIG. 4 is a section of the main throttle shaft and metering rod lifter cam removed from the carburetor shown in FIGS. 1–3.

Referring now to the drawings for a better understanding of this invention, an internal combustion engine carburetor illustrated as a two-stage four-barrel carburetor is generally indicated 10. Carburetor 10 has a body structure indicated generally at 12 which includes a lower body section 14, an intermediate body section 16 and an upper body section 18. Gaskets are provided between sections 14, 16, and 18 together to form body structure 12. Body structure 12 includes a pair of main or primary mixture conduits 20 and 22 with venturis 24 mounted therein. A nozzle 26 is mounted within each venturi 24 and a fuel passage 28 leads to a fuel bowl 30 having a float 32 therein for controlling the flow of fuel into fuel bowl 30. Metering jet 34 is provided in each fuel passage 28 and a suitable metering rod 36 having reduced diameter lower end portions is mounted within metering jet 34 to control the flow of fuel through flow passage 28. It is understood that fuel mixture conduit 22 is arranged with the nozzle and fuel passage arrangement shown for mixture conduit 20.

Figure 3:
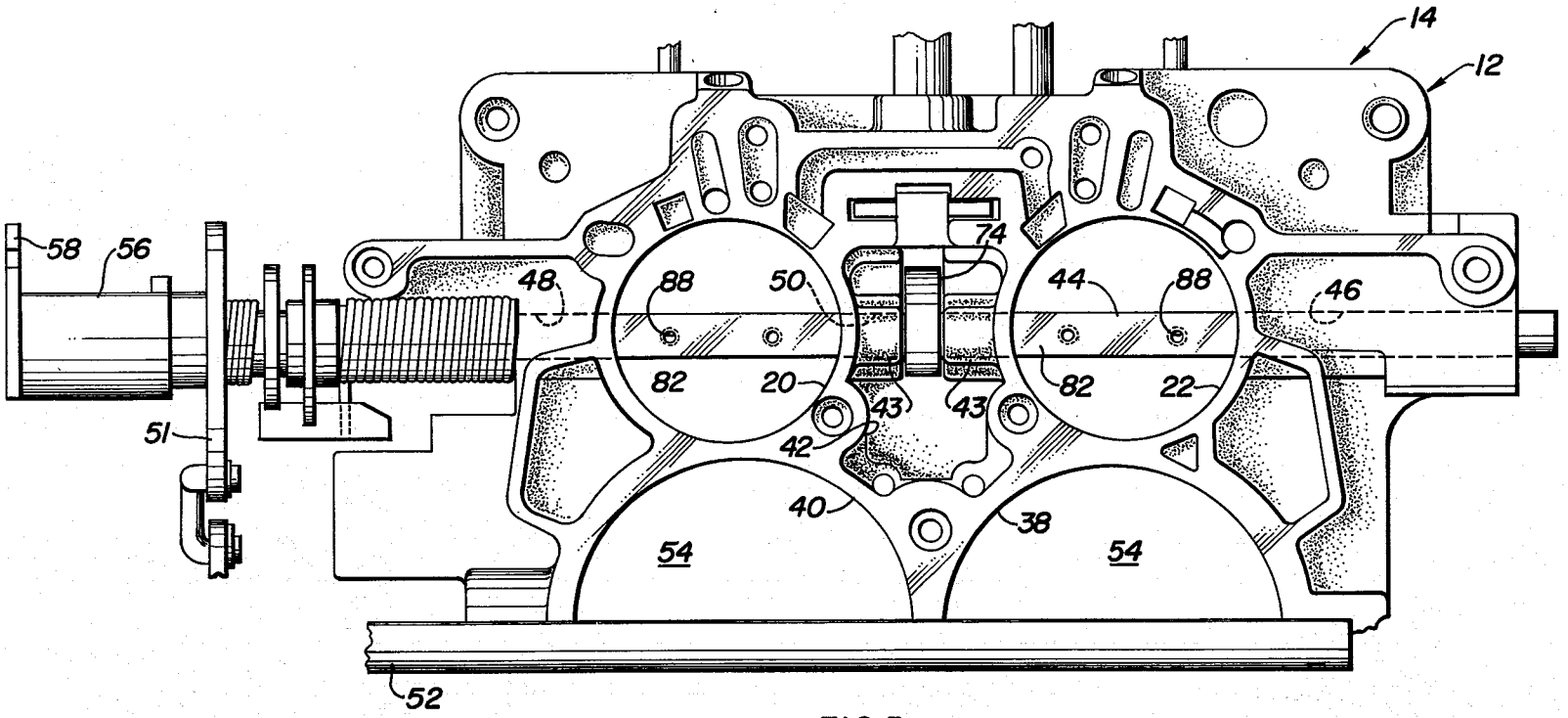
FIG. 3 is a top plan of a lower section of the body structure and showing the main throttle shaft and metering rod lifter cam positioned therein.

Carburetor 10 has a pair of secondary mixture conduits 38 and 40. Primary mixture conduits 20 and 22 are in transverse alignment with secondary mixture conduits 38 and 40 but are of a smaller diameter. Therefore, a space is provided between primary mixture conduits 20 and 22 and a recessed portion 42 is provided in lower body section 14 between primary mixture conduits 20 and 22. A pair of opposed spaced projections 43 extend within recessed portion 42. As shown in FIG. 3 in which a top plan is illustrated for lower body section 14, main throttle shaft 44 is mounted through openings 46, 48, and 50 in lower body section 14. Openings 50 extend through spaced projections 43. An end of main throttle shaft 44 extends from body structure 12 and a suitable linkage illustrated at 51 connects main throttle shaft 44 with a secondary throttle shaft 52 having secondary throttle valves 54 mounted therein within secondary mixture conduits 38 and 40. Mounted on the extending end of main throttle shaft 44 is a suitable link 56 having an arm 58 which may be connected by suitable linkage to a foot pedal or the like for rotation of main throttle shaft 44 by a vehicle operator.

Extending between and suspending metering rods 36 is a carrier arm 60. Rods 36 are pivotally mounted at 62 to carrier arm 60 and a push rod 62 has its upper end portion threaded on carrier arm 60. A piston 64 is integral with arm 60 and is mounted within chamber 66 and a spring 67 within chamber 66 urges piston 64 and arm 60 in an upward direction. A vacuum port 68 communicates chamber 66 with engine manifold and when a vacuum is exerted through port 68 upon engine demand, piston 64 and arm 60 move in a downward direction. The upper end of rod 62 has a slot 69 therein which may be employed to adjust push rod 62 to the desired fuel-air ratio.

Mounted within recess 42 of lower body section 14 is a follower 70 pivotally mounted at 72 to body section 14. Mounted on main throttle shaft 44 is a metering rod lifter cam generally indicated at 74 formed of a C-shape having a central opening 76 and an entrance 78 to the central opening. A projection or tongue 80 extends inwardly within C-shaped opening 76 of cam 74. Throttle shaft 44 has a pair of flats 82 formed but cutaway portions and throttle valves 84 may be secured on flats 82 by screws 86 inserted within threaded opening 88. A cutaway portion 90 of throttle shaft 44 between flats 82 forms a flat having a length slightly greater than the width of cam 74. A slot or groove 92 extends longitudinally or axially of shaft 44 from flat or cutaway portion 90 and communicates with cutaway portion 90. Slot 92 has a taper 94 adjacent its end portion opposite cutaway portion 90. Cam 74 is relatively thick, such as around one-fourth inch in thickness, for example, and is formed of a sintered iron material which has been oil impregnated. Cam 74 engages follower 70 over a relatively large bearing area which minimizes the unit bearing load and the oil impregnation provides lubrication thereby to permit a long life for cam 74.

Figure 2:
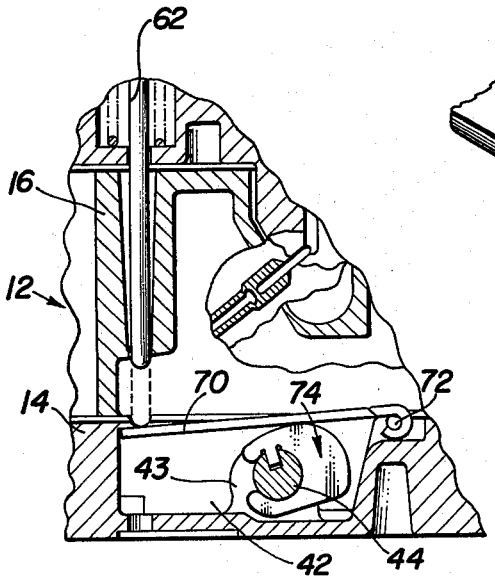
FIG. 2 is a partial transverse section taken through the carburetor body structure and the space formed between the primary mixture conduits shown in FIG. 1.
Figure 5:
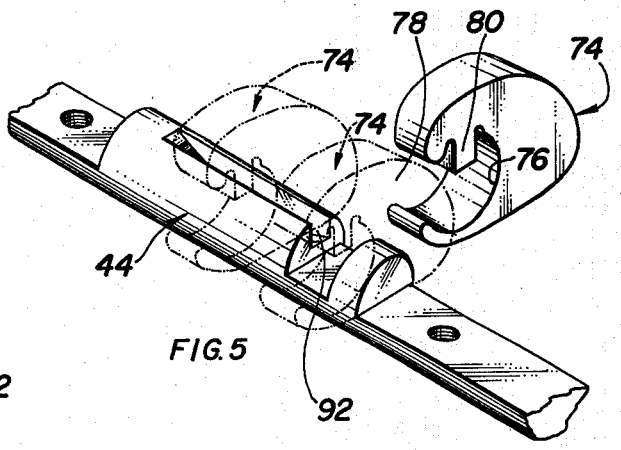
FIG. 5 is a perspective, partly diagrammatic, illustrating the mounting of the metering rod lifter cam on the main throttle shaft.

Cam 74 may be easily assembled on throttle shaft 44 by a simple manual operation. First, throttle shaft 44 is inserted within opening 46, 48 and 50 of lower body section 14 until cutaway poriton 90 is exposed between projections 43 within recessed portion 42. Projections 43 are spaced from each other a distance slightly greater than the width of cam 74 thereby to permit cam 74 to be easily positioned between spaced projections 43 over cutaway portion 90. As shown in FIG. 5, cam 74 is gripped between the fingers of a workman and inserted over cutaway portion 90 and tongue 80 is then aligned with longitudinal groove 92 by turning or rotating shaft 44. Upon alignment of tongue 80 with groove 92, shaft 44 is moved longitudinally to its proper position. In this position, throttle valves 84 are positioned on flats 82 and screws 86 are threaded within openings 88 to secure throttle valves 84 thereon. Throttle valves 84 hold shaft 44 against any longitudinal movement and thereby cam 74 is secured within its position. Upon rotation of throttle shaft 44 after cam 74 has been positioned, follower 70 is moved in an upward direction as shown in FIG. 2 to lift push rod 62 thereby to raise metering rods 36 to increase the flow of fuel through fuel passage 28 to nozzles 26 and mixture conduits 20 and 22.

Cam 74 thus may be easily positioned on a throttle shaft in a minimum of time and without the use of any separate securing elements such as screws or the like which have been employed heretofore. Push rod 62 may be properly adjusted to provide the desired air-fuel ratio in primary mixture conduits 20 and 22 after cam 74 has been mounted on shaft 44.

What is claimed is:

1. An internal combustion engine carburetor comprising a body structure having a pair of spaced parallel mixture conduits, a throttle valve mounted across each of the mixture conduits to control the flow of air through the respective conduit, a throttle shaft extending through the mixture conduits and having an end portion projecting from one side of the body structure, means connected to said end portion for operation of said throttle shaft, a fuel passage to each of the mixture conduits each fuel passage having a fuel metering jet therein, a metering rod positioned within each of the metering jets and permitting an increased flow of fuel through the associated fuel passage when moved in an upward direction, a generally horizontally extending carrier arm extending between and connected to said metering rods for movement of said metering rods in a generally vertical direction, a push rod operatively connected to said arm and having its lower end positioned in the vicinity of said throttle shaft, a pivotally mounted cam follower engaging the lower end of the push rod, a cam on said throttle shaft in engagement with said follower, and means mounting said cam on said shaft, said mounting means including a cutaway portion of said shaft having a length greater than the thickness of said cam and an axially extending slot having an end communicating with said cutaway portion, said cam being C-shaped and having an inwardly projected tongue fitting within said slot and securing said cam in position on said shaft.

2. An internal combustion engine carburetor as set forth in claim 1 wherein said body structure has a recessed portion in the space between the mixture conduits and a pair of opposed projections are positioned within the recessed portion spaced from each other a distance greater than the thickness of said cam, and an axial opening extends through said body structure including said projections for receiving said throttle shaft, said cam being mounted on said shaft in the space between said projections.

3. In combination with an internal combustion engine carburetor having a body structure including a pair of spaced parallel mixture conduits, a throttle shaft extending through the mixture conduits, a fuel passage to each of the mixture conduits each fuel passage having a metering rod to control the fuel flow through the associated fuel passage, a generally horizontally extending carrier arm extending between and suspending the metering rods for movement of said metering rods in a generally vertical direction, a push rod operatively connected to said carrier arm and having a lower end positioned in the vicinity of said throttle shaft between the pair of mixture conduits, a pivotally mounted cam follower engaging the lower end of the push rod, and a cam on said throttle shaft in engagement with the follower, the improvement comprising means mounting the cam on the throttle shaft, said mounting means including an axially extending slot on said shaft and a cutaway portion of said shaft communicating with said slot, said cam being C-shaped for fitting over said cutaway portion and having an inwardly projecting tongue fitting within said slot for securing said cam in position on said shaft.

4. The combination as set forth in claim 3 wherein said C-shaped cam is formed of oil impregnated sintered iron.

5. The combination as set forth in claim 3 wherein said body structure has a recessed portion in the space between the mixture conduits and a pair of opposed projection are positioned within the recessed portion spaced from each other a distance greater than the thickness of said cam, and an axial opening extends through said body structure including said projections for receiving said throttle shaft, said cam being mounted on said shaft in the space between said projections.

6. A method of securing a generally C-shaped metering rod lifter cam having an inwardly extending tongue on the main throttle shaft of a four-barrel internal combustion engine carburetor in the space formed between a pair of main mixture conduits, the throttle shaft extending through the main mixture conduits and the space formed between the mixture conduits and having an axial slot and cutaway portion communicating with the slot, said method comprising the steps of first inserting the throttle shaft through openings in the carburetor body to a position in which the cutaway portion is positioned in the space between the mixture conduits, then inserting the C-shaped cam over the cutaway portion and aligning axially the tongue with the slot in the throttle shaft, and next moving the throttle shaft longitudinally to fit the tongue within the slot for securing the cam in position thereon.

7. The method as set forth in claim 6 wherein throttle valves are secured to the throttle shaft after the cam has been mounted thereon thereby to secure the throttle shaft against longitudinally movement relative to the carburetor body.

* * * * *